United States Patent [19]

Roy et al.

[11] Patent Number: 4,684,171

[45] Date of Patent: Aug. 4, 1987

[54] FOLDING WHEELCHAIR

[75] Inventors: Jehan Roy; Jean Dubois, both of Tours, France

[73] Assignee: Lacoste, SA, Saint-Pierre-Des-Corps, France

[21] Appl. No.: 865,095

[22] Filed: May 20, 1986

[30] Foreign Application Priority Data

Nov. 16, 1984 [FR] France ..... 8417485

[51] Int. Cl.[4] ..... A47C 4/00

[52] U.S. Cl. ..... 297/47; 280/242 WC

[58] Field of Search ..... 297/47, 130, 131; 280/242 WC, 641, 646, 657

[56] References Cited

U.S. PATENT DOCUMENTS

| | | | |
|---|---|---|---|
| 2,612,209 | 9/1952 | Alldredge et al. . | |
| 3,482,850 | 12/1969 | Fay | 280/641 |
| 3,887,228 | 6/1975 | Ingerson | 280/242 WC |
| 4,380,343 | 4/1983 | Lovall | 280/242 WC |
| 4,398,736 | 8/1983 | De Winjn | 280/646 X |

FOREIGN PATENT DOCUMENTS

| | | | |
|---|---|---|---|
| 2349264 | 4/1975 | Fed. Rep. of Germany | 297/47 |
| 639439 | 6/1950 | United Kingdom . | |
| 646902 | 11/1950 | United Kingdom . | |
| 1436940 | 5/1976 | United Kingdom . | |

*Primary Examiner*—James T. McCall

*Attorney, Agent, or Firm*—Young & Thompson

[57] ABSTRACT

A foldable armchair comprising a seat frame disposed in a first plane, and wheels rollingly supporting the frame. The wheels are carried by at least two legs rotatably mounted at their upper ends on the frame about first and second axes of rotation respectively. These first and second axes are substantially parallel to the first plane and coaxial, the other extremities of the two legs being connected to at least one roller by a device having at least two degrees of freedom of rotation. The two legs lie substantially in a second plane substantially parallel to the first plane. An upright is rotatably mounted about a third axis parallel to the first and second axes, and a bar interconnects the two legs. A telescoping lever variable in length between two limited positons, is rotatably mounted at one end on the upright and at its other end on the bar, so as to be able to drive the legs in rotation about the first and second axes.

8 Claims, 4 Drawing Figures

Figure 1:
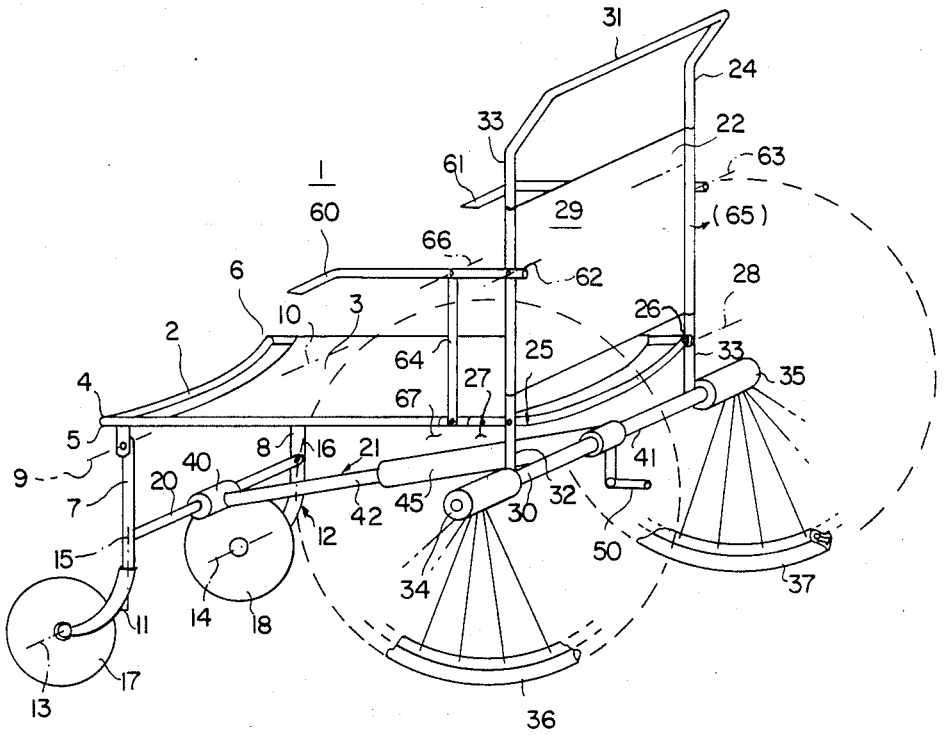

FIG. 2A
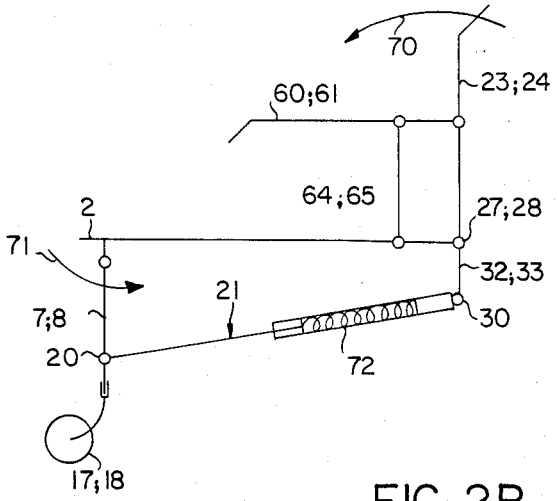
FIG. 2B
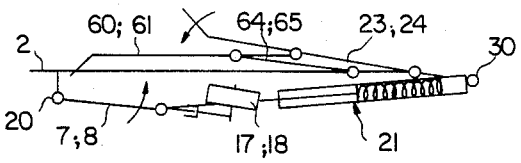
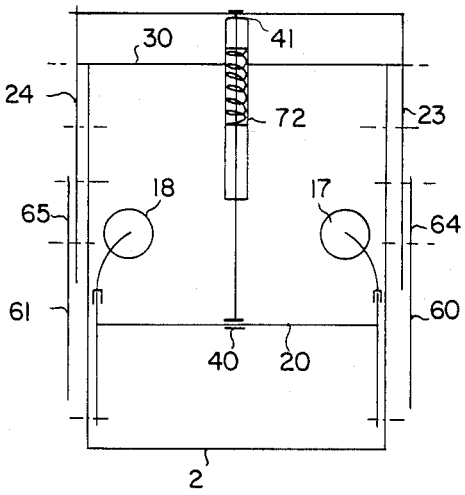
FIG. 2C

FOLDING WHEELCHAIR

The present invention concerns folding armchairs, and more particularly folding wheelchairs which are ordinarily used by the physically handicapped.

Despite the significant progress realized, these persons always need their wheelchair such that they must take it with them on all occasions and to all places. To this end, special wheelchairs have been realized, such that they are foldable and occupy a minimum required space in all dimensions. Moreover, so as to facilitate their handling, it has been thought to reduce the maximum the weight of these wheelchairs, by choosing the lightest possible materials which nonetheless have a certain rigidity, and by realizing structures which permit reducing the number of elements involved in their composition.

In all the known folding armchairs, the following characteristics have never successfully been brought together, that is lightness, facility of handling at the time of folding and unfolding, rigidity of handling at the time of folding and unfolding, rigidity at the time of rolling and the minimum required space once folded.

Therefore, the present invention proposes a foldable armchair of the wheelchair type satisfying all the criteria enumerated above.

This folding armchair comprises:

a seat frame, defined in a first plane, rolling means for permitting displacement of the said frame, the said rolling means comprising at least two legs and second means for rotatably mounting an extremity of each leg on the said frame about first and second axes of rotation, respectively, the said first and second axes being essentially parallel to the said first plane and colinear, the other extremities of the said two legs being associated with at least one roller by rotation means having at least two degrees of freedom of rotation, the said two legs being essentially in a second plane substantially perpendicular to the first, and traction means controllable on at least one of the said two legs, so as to bring them in rotation about the said second axis.

Other characteristics and advantages of the present invention will appear in the course of the following description given in connection with the accompanying drawings by way of illustrative but non-limiting embodiment in which:

FIG. 1 shows in partially broken away perspective, and in relatively simplified form, an embodiment of a wheelchair according to the invention, and FIGS. 2A, 2B, 2C, show very schematically the embodiment of the wheelchair according to FIG. 1, in a set of three views permitting ready comprehension of the manner in which this wheelchair is folded and unfolded, as well as the advantages of its structure.

It is first stated that the group of Figures shows a same and single embodiment of the wheelchair according to the invention. Consequently, the same reference numerals designate the same elements, even when these latter are illustrated in different views.

Referring more particularly to FIG. 1, this latter shows a foldable wheelchair 1, comprising a frame 2 formed for example from four welded tubes forming a square on which is retained, for example, a canvas 3 so as to form a seat on which a person may be seated. In the general form, this seat frame 2 forms a first plane for positioning and seating of the person whom it is intended to receive.

On a first side 4 of this frame 2, essentially at the ends 5 and 6 of the frame, are mounted respectively two legs 7 and 8 about axes of rotation 9 and 10, respectively. The means for obtaining this function are generally constituted by a shaft mounted respectively on two bearings belonging respectively to the frame 2 and to the legs 7 and 8. In this embodiment, the direction of the axis 9 and 10, about which may be rotated the legs 7 and 8, is defined such that they be essentially parallel to the plane as defined above through the seat frame 2 and, moreover, that they be aligned and thus colinear, each one of them being advantageously perpendicular to the normal direction of travel of such a wheelchair. This advantageous structure permits a synchronization in the folding of the two legs 7 and 8, as will be described later, particularly with regard to FIG. 2.

With these two legs 7 and 8 are respectively associated rollers 17 and 18, by rotation means, respectively 11 and 12, which permit, on the one hand a first rotation of the rollers about their natural axis, the respective axes 13 and 14, and on the other hand a second rotation of the rollers about an axis contained in their plane. In this embodiment, these two latter axes, respectively 15 and 16, are perpendicular to the two axes 13 and 14 and aligned with the axes of the two legs 7 and 8. The rotation means of the roller, such as the roller 17 about its axis 13, are realized in a conventional manner, as well as the rotation means about the axes 15 and 16 which are generally obtained by sprockets cooperating by rotative sliding with the interior of housings effected respectively on the two extreme faces of the two legs 7 and 8 along their axis. These means being known in themselves, will not be more particularly described here.

In the case where the two axes of rotation 9 and 10 respectively of the legs 7 and 8 are colinear, the two legs 7 and 8 are connected in a rigid manner by a crosspiece 20 fixed essentially to the extremity of the legs opposite to that which cooperates in rotation with the frame 2. Thus, so as to obtain the folding of the wheels, the armchair may comprise means schematically illustrated at 21 permitting pulling on the assembly of these two legs 7 and 8 and causing them to subject to a rotation about the two axes 9 and 10. These means 21 may if desired lock the two legs in the illustrated position, that is to say the said rolling position of the armchair.

Nevertheless, in an advantageous form, and necessary for such a type of wheelchair when it is intended to be used by handicapped persons, it must comprise a back 22. In the embodiment, the back is constituted by two uprights 23 and 24 rotatively mounted at one of their extremities respectively on the two other ends 25 and 26 of the square frame 2, respectively about two other axes 27 and 28 which are advantageously colinear.

These uprights are disposed such that they be largely situated above the plane of the seat so that they may subtend a second canvas 29 so as to form the back which, with the seat frame 2, forms an armchair. These uprights similarly extend from the plane of the seat 2 over a slight distance so as to be able to support, when the two axes 27 and 28 are colinear, a second crosspiece 30 which permits rigidifying together the two uprights 23 and 24. These two uprights may also be connected by a rigidifying bar 31 mounted to the other extremities of the two uprights, which bar permits constituting, moreover, a means for pushing or pulling the wheelchair when it is necessary to displace it by itself, or with a person to be transported.

The rigidifying bar 30 which is found respectively at the extremities 32 and 33 respectively from the two upights 23 and 24, is ordinarily situated, when the armchair rolls on the ground, below the seat frame 2, and more particularly below its plane, and on the same side of this plane as the two legs 7 and 8 with which are associated the same two rollers 17 and 18.

For a conventional wheelchair, this rigidifying bar comprises at its two extremities 34 and 35 bearing means permitting receiving two large removable wheels, respectively 36 and 37, such as bicycle wheels. The means of association of these two wheels 36 and 37 to the bearing means 34 and 35 are well known in themselves and will not be more particularly described. Nevertheless it is stated that these means permit very easily dissociating each wheel from the seat frame 2, for example by pressing on a catch for freeing the axles of these wheels which are adapted to penetrate into openings effected in these bearings 34 and 35.

The two uprights 23 and 24 fixed to one another, particularly by means of two rigidifying bars 30 and 31, may thus pivot simultaneously about axes 27 and 28, respectively, which are selected parallel to the axes 9 and 10 defined previously.

In an advantageous embodiment, the two bars consituting the two cross pieces 20 and 30 are connected by an extensible lever in a telescoping manner the length of which may vary between two predetermined lengths. This extensible lever constitutes, in fact, the traction means 21 which was mentioned previously. In an advantageous embodiment, this extensible lever is rotatably mounted at its two extremities to bearings 40 and 41 respectively on the two cross pieces 20 and 30. This extensible lever may be constituted by a rod assembly 42 sliding to the interior of a cylinder 43 against a spring which appears particularly in FIG. 2, in the form of a traction spring, this spring permitting effecting a traction so as to cause the rod 42 to reenter into the cylinder 43. The maximum length of this lever is given when the rod 42 is withdrawn to the maximum, that is to say when the piston which slides to the interior of the cylinder 43 comes in contact against a base of this latter. The minimum length of this lever is given when the piston maximally compresses the spring. It will be understod that these two dimensional values of the lever, maximum and minimum, are determined as a function of the folding of the armchair and of the desired position respectively of the legs and the uprights (for example inclination of these latter with respect to the seat frame when the chair is unfolded and ready to be rolled), their determination posing no problem to the skilled artisan.

It will be understood, in the embodiment, so as to facilitate comprehension of the system, a simple extensible lever has been illustrated by a rod cooperating with a cylinder through the intermediary of a spring. Nevertheless there exist such levers which are known in themselves and which are generally characterized by an elasticity provided by a compressible gas. The advantage of these extensible levers is that they may be controlled and locked at will. The locking and control means of such a lever has been schematically illustrated by a handle 50 which may be easily actuated by a person to use, that is to fold or unfold, such a chair.

Such a wheelchair may be usable by a handicapped person only if it has armrests. Accordingly, there are provided two armrests respectively 60 and 61 the respective extremities of which are rotatably mounted about two axes 62 and 63 on the uprights 23 and 24. In an advantageous manner these two armrests 60 and 61 may be essentially parallel to the plane of the seat and remain there as long as the person uses the chair. So as to able to maintain these two armrests in this position, there are provided small levers 64 and 65, the lever 65 being hidden by the canvas 29, which connect, about two axes of rotation, respectively 66 and 67 for the rod 64, the armrest 60 to a rigid bar of the frame 2. The same is the case for the other armrest. Nevertheless, the length of the small lever 64 taken between its two axes of rotation 66 and 67 is determined in such a manner that it is equal to the distance separating the two axes of rotation 27 and 62 defined previously, such that the set of the four axes of rotation 27, 62, 66, and 67 defines a parallelogram which may be deformed if desired when the assembly of the elements connected to these axes pivots the ones with respect to the others.

The advantages of the folding of the chair according to the invention appears particularly with regard to FIGS. 2A, 2B, 2C.

FIG. 2A shows in very schematic side view the embodiment of the chair according to FIG. 1, in a configuration where the two large wheels 36 and 37 have been removed. It has been stated that the two armrests 60 and 61, the two uprights 23 and 24, as well as the frame 2, have their respective positions permitting a handicapped person to be seated on the canvas 3. This position illustrated in FIG. 2, although the large wheels are not shown, is the normal position of use of such a chair, the said unfolded position.

When it is necessary to fold such a chair, one acts on the control means 50 for unlocking the lever means 21 and on the means for locking if desired the legs 7 and 8, in such a fashion that in acting on the two uprights 23 and 24, particularly by pressing on the rigidifying bar 31, they're subjected to a movement of rotation as illustrated in FIG. 2 by the arrow 70 so as to draw nearer these two uprights 23 and 24 to the lateral sides of the frame 2. In these conditions, the extremities 32 and 33 of these two uprights, particularly through the intermediary of the cross piece 30, the lever 21 and of the traction spring 72 whatever form it may have, pull on the crosspiece 20 to drive a rotation of the two legs 7 and 8 in the direction of the arrow 71, so as to restore these two legs 7 and 8 beneath the frame 2 and the canvas 3.

Once the movement has terminated, the chair has taken a folded position as shown in FIG. 2B. It will seen that because the rotation of wheels about particularly the vertical axes 15 and 16, the two wheels where able to pivot and to come to be put flat beneath the seat 3 and thus occupy a minimum of space.

Nevertheless, as the distance separating the axes 9 and 10 respectively from the axis 40 and the distance separating the axes 27 and 28 respectively from the axis 41 are not equal, the extensible lever 21 must be able to assume two positions of length, one which corresponds to its maximum length when the seat is in unfolded position as shown in FIG. 2 and when the two legs 7 and 8 exert a traction on the spring so as to lengthen it, and another which corresponds to its minimum length obtained by the maximum traction force of the spring 72 which tends to make the rod 42 reenter into the interior of the cylinder 45.

In the example illustrated, the extensible lever 21 has been shown by a traction spring 72 of the helical type, but it is evident that it could be advantageously realized by a spring of the "air spring" type with a compressible gas.

The advantage of such a system will thus be seen, particularly at the time of folding which permits obtaining a minimum space requirement in height since all the elements are well layered the ones on the others and since, with respect to FIG. 2C, even the rollers ae perfectly horizontally positioned beneath the seat frame 2.

It will be understood that the large wheels such as the wheels 36 and 37 will be transported separately. Moreover, it has been stated that even the armrests 60 and 61 are perfectly layered against the frame, because the parallelogram defined by the four axes of rotation mentioned previously and their respective positions on the uprights 23, 24, the armrests 60, 61 and the sides of frame 2 is deformed in a known manner.

Once the chair is folded, it may be easily transported. It will be understood that when the chair is unfolded as it appears in FIG. 1 or FIG. 2A, so as to be usable, on the one hand the lever 21 is locked in length by means of the handle 50, and on the other hand, for example, at least one of the two legs 7 and 8 is locked with respect to the frame 2, by manual means such as catches, so as to obtain a perfectly rigid seat which may thus be used without danger. In effect, if the two legs 7 and 8 are perfectly locked with respect to the frame 2 and the lever 21 has a predetermined length fixed by the control means 50, the other elements such as the uprights 23 and 24, the armrests 60 and 61 will be perfectly positioned and rigidified without any difficulty and the chair may thus be used with total safety.

What is claimed is:

1. Foldable armchair comprising:

a seat frame disposed in a first plane, rolling means rollingly supporting the said frame, the said rolling means comprising at least two legs and means for rotatably mounting an extremity of each leg on the said frame about first and second axes of rotation respectively, said first and second axes being substantially parallel to the said first plane and coaxial, the other extremities of the two legs being connected to at least one roller by rotation means having at least two degrees of freedom of rotation, the said two legs lying substantially in a second plane substantially parallel to said first plane, an upright rotatably mounted about a third axis parallel to said first and second axes, a bar interconnecting said two legs, and a telescoping lever variable in length between two limited positions, said telescoping lever being rotatably mounted at one end on the said upright and at its other end on the said bar, so as to be able to drive said legs in rotation about said first and second axes.

2. Armchair according to claim 1, in which the said upright comprises at least a fourth axis of rotation of a wheel removably mounted on a said armchair for rotation about said fourth axis.

3. Armchair according to claim 1, in which the said legs are mounted substantially on a side of the seat frame and the said upright is mounted on an opposite side of the seat frame.

4. Armchair according to claim 1, and an armrest rotatably mounted on the said upright about a fifth axis of rotation out of alignment with said fourth axis.

5. Armchair according to claim 4, and a small lever rotatably mounted between the said armrest and the said frame, between sixth and seventh axes at opposite ends of said small lever, the distance separating said sixth and seventh axes being equal to the distance separating said third and fifth axes, such that said small lever, the armrest, the upright and said frame form a deformable parallelogram.

6. Armchair according to claim 1, in which said means for mounting the said rotatable roller on an extremity of said leg comprises at least an eighth axis of rotation about which the roller rotates, and a ninth axis permitting the said roller to swivel about an axis substantially parallel to the rolling plane of the said roller.

7. Armchair according to claim 6, in which said eighth axis is horizontal and said ninth axis is vertical.

8. Armchair according to claim 2, in which said first, second, third and fourth axes are horizontal and parallel to each other.

* * * * *